US012304601B2

(12) United States Patent
Godoy

(10) Patent No.: US 12,304,601 B2
(45) Date of Patent: May 20, 2025

(54) BUOYANCY CONTROL DEVICE FOR SCUBA DIVING

(71) Applicant: CRESSI-SUB S.P.A., Genoa (IT)

(72) Inventor: Carlos Alberto Godoy, Genoa (IT)

(73) Assignee: CRESSI-SUB S.P.A., Genoa (IT)

( * ) Notice: Subject to any disclaimer, the term of this patent is extended or adjusted under 35 U.S.C. 154(b) by 11 days.

(21) Appl. No.: 17/967,212

(22) Filed: Oct. 17, 2022

(65) Prior Publication Data

US 2023/0150628 A1 May 18, 2023

(30) Foreign Application Priority Data

Nov. 12, 2021 (IT) ..... 102021000028802

(51) Int. Cl.
*B63C 11/22* (2006.01)
*B63C 11/30* (2006.01)

(52) U.S. Cl.
CPC ..... *B63C 11/30* (2013.01); *B63C 2011/303* (2013.01)

(58) Field of Classification Search
CPC ... B63C 11/30; B63C 2011/303; B63C 11/08; B63C 2011/026; B63C 11/02; B63C 11/04; B63C 11/22
See application file for complete search history.

(56) References Cited

U.S. PATENT DOCUMENTS 617,675 A * 1/1899 Crawford ..... B63C 11/30 224/663
1,076,820 A * 10/1913 Darssin ..... B63C 11/30 405/186
1,480,417 A * 1/1924 Irving ..... B63C 9/115 441/115
2,943,775 A * 7/1960 Mack ..... A62B 9/04 224/628
2,968,159 A * 1/1961 Everett ..... B63C 11/30 405/186
3,034,596 A * 5/1962 Twaits, Jr. ..... B64D 17/32 24/DIG. 30
3,035,747 A * 5/1962 Ullrich, Jr. ..... B63C 11/30 224/265

(Continued)

FOREIGN PATENT DOCUMENTS

DE 19504545 A1 8/1996
EP 0853037 A2 7/1998

OTHER PUBLICATIONS

Search Report and Written Opinion issued in Italian Patent Application No. 202100028802 on Jul. 6, 2022 (Written Opinion English translation).

*Primary Examiner* — Edwin J Toledo-Duran

(74) *Attorney, Agent, or Firm* — TROUTMAN PEPPER LOCKE LLP

(57) ABSTRACT

The buoyancy control device for scuba diving comprises an air bladder, a harness comprising at least two shoulder straps and an abdominal strap made up of two abdominal half-straps, a backrest provided with first slots engaged by the abdominal half-straps, second slots engaged by at least one retaining strap for retaining at least one air cylinder, one or more third slots engaged by the two shoulder straps, and one or more fourth slots engaged by corresponding straps for connecting the backrest to the air bladder.

8 Claims, 6 Drawing Sheets

(56) References Cited

U.S. PATENT DOCUMENTS 3,090,205 A * 5/1963 Hurwitz ..... B63C 11/30 405/186
3,174,664 A * 3/1965 Hue ..... B63C 11/30 224/604
3,263,432 A * 8/1966 Ford ..... B63C 11/30 24/115 R
3,670,509 A * 6/1972 Walters ..... B63C 11/30 114/315
3,891,131 A * 6/1975 Tabata ..... B63C 11/30 224/628
3,957,183 A * 5/1976 Gadberry ..... B63C 11/02 224/628
4,016,616 A * 4/1977 Walters ..... B63C 11/46 114/315
4,114,389 A * 9/1978 Bohmrich ..... B63C 11/2245 441/96
4,137,585 A * 2/1979 Wright, III ..... B63C 11/2245 128/204.26
4,181,126 A * 1/1980 Hendry ..... B63C 11/22 128/201.21
4,398,533 A * 8/1983 Barker ..... B63C 11/02 128/202.15
4,690,314 A * 9/1987 Faulconer ..... B63C 11/08 224/628
5,020,941 A * 6/1991 Bulin ..... B63C 11/04 405/186
5,046,894 A * 9/1991 Bergstrom ..... B63C 11/02 441/106
5,256,094 A * 10/1993 Canna ..... B63C 11/08 441/96
5,346,419 A * 9/1994 Kaiser ..... B63C 11/08 441/96
5,363,790 A * 11/1994 Matsuoka ..... B63C 11/08 405/186
5,390,886 A * 2/1995 Lawner ..... B63C 11/02 248/224.7
5,562,513 A * 10/1996 Kaiser ..... B63C 11/08 405/186
5,567,084 A * 10/1996 Oliver ..... B63C 11/2245 256/32
5,626,439 A * 5/1997 Rowlands ..... B60P 7/0838 405/185
5,785,567 A * 7/1998 Modugno ..... B63C 11/08 441/88
5,902,073 A * 5/1999 Eungard ..... B63C 11/30 405/187
5,906,302 A * 5/1999 Spergel ..... A62B 25/00 248/213.2
D415,013 S * 10/1999 Griffiths ..... D8/354
6,120,213 A * 9/2000 Stinton ..... B63C 11/08 405/186
6,146,053 A * 11/2000 Nelson ..... B63C 11/30 224/664
6,158,872 A * 12/2000 Rodgers ..... H05B 39/09 362/802
6,183,164 B1 * 2/2001 Canella ..... B63C 11/08 405/186
6,244,784 B1 * 6/2001 Gordon ..... B63C 11/08 441/108
6,341,789 B1 * 1/2002 Checa ..... B62B 1/264 280/47.28
6,367,753 B1 * 4/2002 Berg ..... A62B 9/04 248/223.41
6,409,429 B1 * 6/2002 Belloni ..... A62B 25/00 224/907
6,477,709 B1 * 11/2002 Kawana ..... B63C 11/08 2/2.15
6,973,928 B1 * 12/2005 Taylor, II et al. ..... B63C 11/22 128/201.27
8,398,337 B2 * 3/2013 Jablonski ..... B63C 11/02 224/660
8,834,069 B1 * 9/2014 Harvey ..... B63C 11/08 137/505.46
11,814,145 B2 * 11/2023 Godoy ..... B63C 11/02
2002/0111096 A1 * 8/2002 Kawashima ..... A44B 11/125 441/116
2004/0005196 A1 * 1/2004 Canella ..... B63C 11/08 405/186
2004/0082238 A1 * 4/2004 Jacoway ..... B63C 11/02 405/187
2005/0084335 A1 * 4/2005 Matsuoka ..... B63C 11/22 405/186
2005/0098597 A1 * 5/2005 Cottrell ..... B63C 11/30 224/629
2005/0241348 A1 * 11/2005 Devecki ..... E05B 73/0005 70/58
2005/0269470 A1 * 12/2005 Ficarra ..... B63C 11/02 248/304
2007/0138226 A1 * 6/2007 Marinaj ..... F41C 33/046 224/232
2009/0217927 A1 * 9/2009 Stood ..... B63C 11/08 128/202.19
2010/0282793 A1 * 11/2010 Wrigley ..... A62B 9/04 224/246
2011/0117802 A1 * 5/2011 Bonacci ..... B63C 11/02 441/129
2015/0232159 A1 * 8/2015 Masutani ..... B63C 11/30 405/186
2019/0022432 A1 * 1/2019 Trowbridge ..... G09B 9/00
2021/0024186 A1 * 1/2021 Keesaer ..... A61G 1/048
2022/0324545 A1 * 10/2022 Godoy ..... B63C 11/02
2023/0150626 A1 * 5/2023 Godoy ..... B63C 11/02 405/186

* cited by examiner

BUOYANCY CONTROL DEVICE FOR SCUBA DIVING

CROSS REFERENCE TO RELATED APPLICATIONS

This application claims benefit of priority to Italian Patent Application No. 102021000028802, filed Nov. 12, 2021, the entire contents of which are hereby incorporated by reference.

FIELD

The present invention relates to a buoyancy control device for scuba diving.

BACKGROUND

Buoyancy control devices (BCD) have been known and present on the market for some time as individual accessories for scuba diving used to increase the diver's ability to control the level of depth to be maintained or varied during a dive.

A BCD comprises an air bladder, a harness and a backrest which enables the assembly between the cylinder(s), the harness and the air bladder.

The expandable air bladder, generally made of synthetic materials, is inflated with air coming from the cylinder(s), and the volume thereof is regulated by inflation and deflation valves directly controlled by the diver: the increase or decrease in volume has a direct effect on hydrostatic thrust and therefore helps the diver to maintain or reach the hydrostatic balance required and desired at the various diving depths.

The harness normally comprises two adjustable shoulder straps, an adjustable abdominal strap enabling the device to be secured in the belly area, and an adjustable chest strap enabling a distribution of weight from the shoulders to the chest area.

The backrest, generally rigid, has an internal plate provided with various slots for adjusting the harness and a shaped area for lumbar support, and an external plate provided with a shaped area for supporting and constraining the cylinder(s).

The rigid backrest is fixed directly to the air bladder in various ways, normally by means of bolts which join the internal plate to the external plate by passing through holes in the air bladder.

One of the problems that may be found in the known backrest fixing systems consists in the fact that it transfers the weight of the cylinder(s) to the air bladder, thus generating intense mechanical stresses on the air bladder which may compromise the structural integrity thereof over time.

Another problem tied to a traditional backrest is related to its excessive weight and bulk, which may penalise the wearing comfort of the BCD for the diver and complicate packing of the BCD in backpacks or suitcases for transport.

SUMMARY

The technical task of the present invention is thus to provide a buoyancy control device for scuba diving which enables the aforesaid technical drawbacks of the prior art to be eliminated.

Within the scope of this technical task, one object of the invention is to provide a buoyancy control device for scuba diving that is robust and resistant, lightweight, comfortable to wear and practical to pack.

The technical task, as well as these and other objects, are achieved according to the present invention by providing a buoyancy control device for scuba diving comprising an air bladder, a harness comprising at least two shoulder straps and an abdominal strap made up of two abdominal half-straps, a backrest provided with first slots engaged by said abdominal half-straps, second slots engaged by at least one retaining strap for retaining at least one air cylinder, and one or more third slots engaged by said two shoulder straps, characterised in that said backrest comprises one or more fourth slots engaged by corresponding straps for connecting said backrest to said air bladder.

In one embodiment of the invention, said connecting straps support said backrest floatingly with respect to said air bladder.

In one embodiment of the invention, said connecting straps are fastened by stitches to said air bladder.

In one embodiment of the invention, said connecting straps are flexible.

In one embodiment of the invention, each connecting strap is removably engaged in a fourth corresponding slot.

In one embodiment of the invention, at least one connecting strap has an end with a double lip engaged in a fourth corresponding slot.

In one embodiment of the invention, said backrest is positioned through a through opening of said air bladder.

In one embodiment of the invention, one or more connecting straps are fixed along the perimeter of said through opening.

In one embodiment of the invention, said backrest has a fifth slot engaged by a crotch strap.

Advantageously, the backrest, not being rigidly connected to the air bladder, is able to transfer the mechanical stresses due to the weight of the cylinder(s) directly to the shoulder straps and abdominal strap, thereby relieving the strain on the air bladder, which can thus maintain its structural integrity for a long time.

BRIEF DESCRIPTION OF THE DRAWINGS

Additional features and advantages of the invention will be more apparent from the description of a preferred, but not exclusive embodiment of a buoyancy control device for scuba diving according to the invention, illustrated by way of non-limiting example in the appended drawings, in which.

Figure 1:
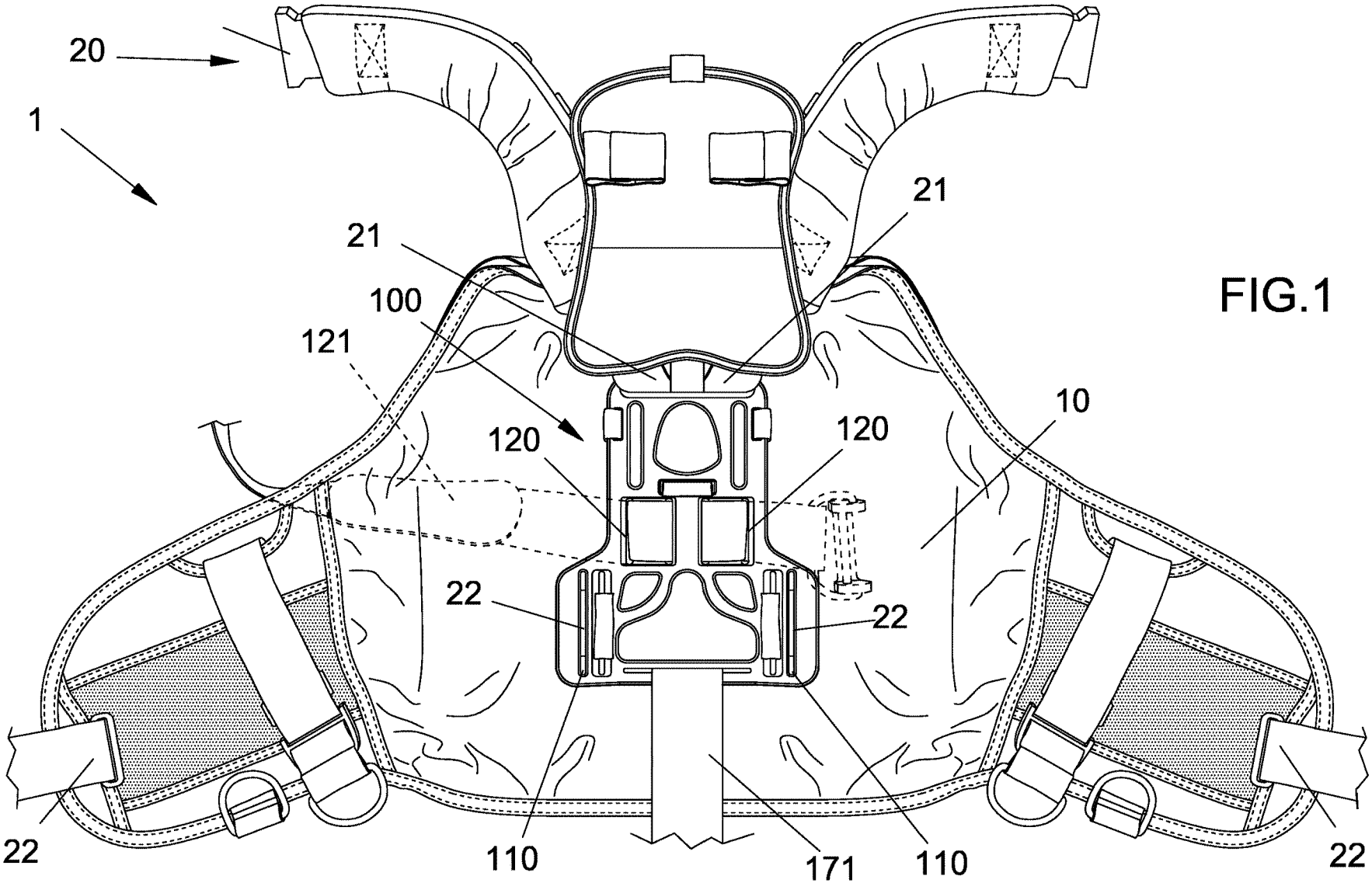
FIG. 1 shows an overall internal view of the buoyancy control device.
Figure 2:
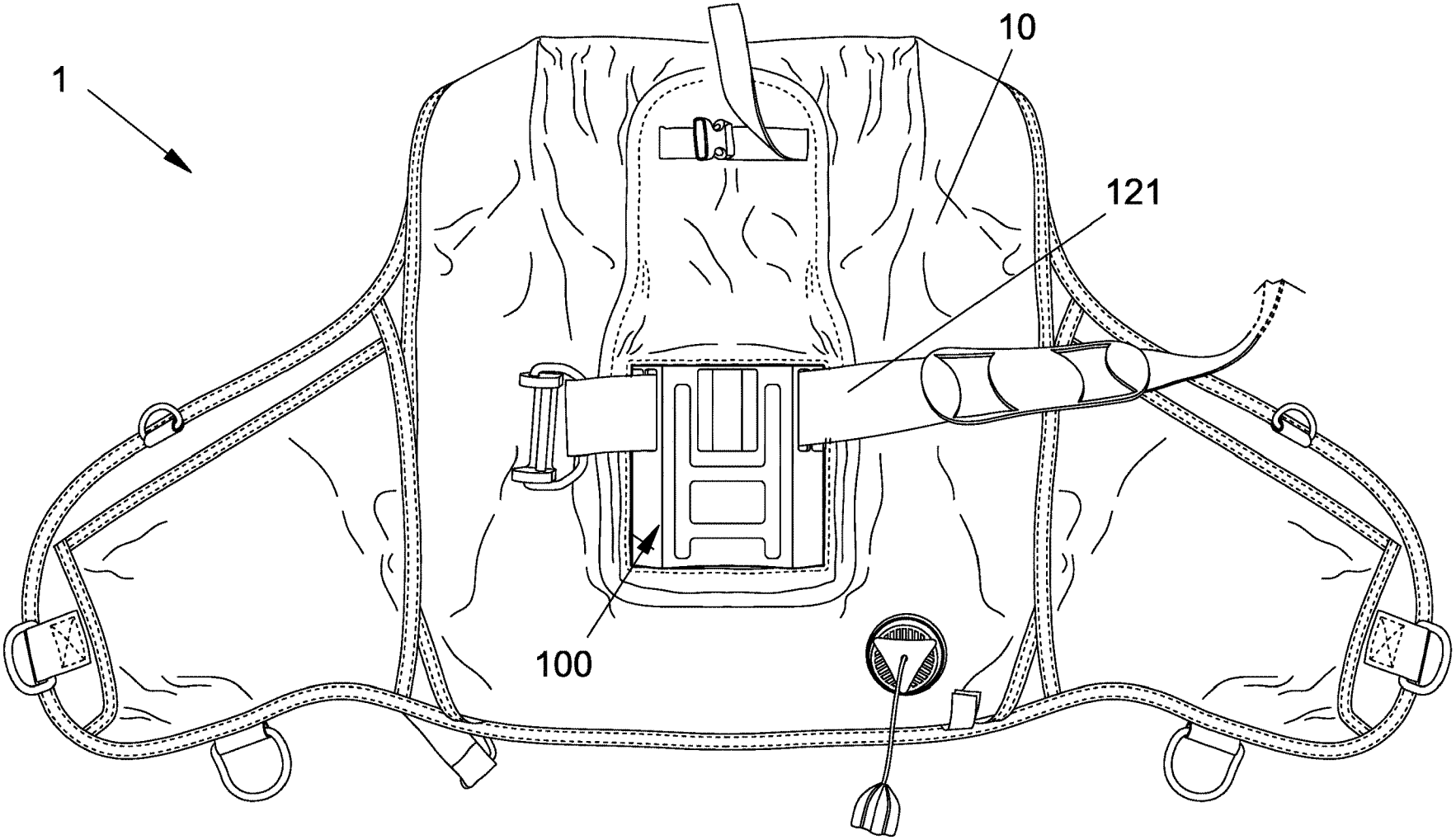
FIG. 2 shows an overall external view, relative to the diver's body, of the buoyancy control device.
Figure 3:
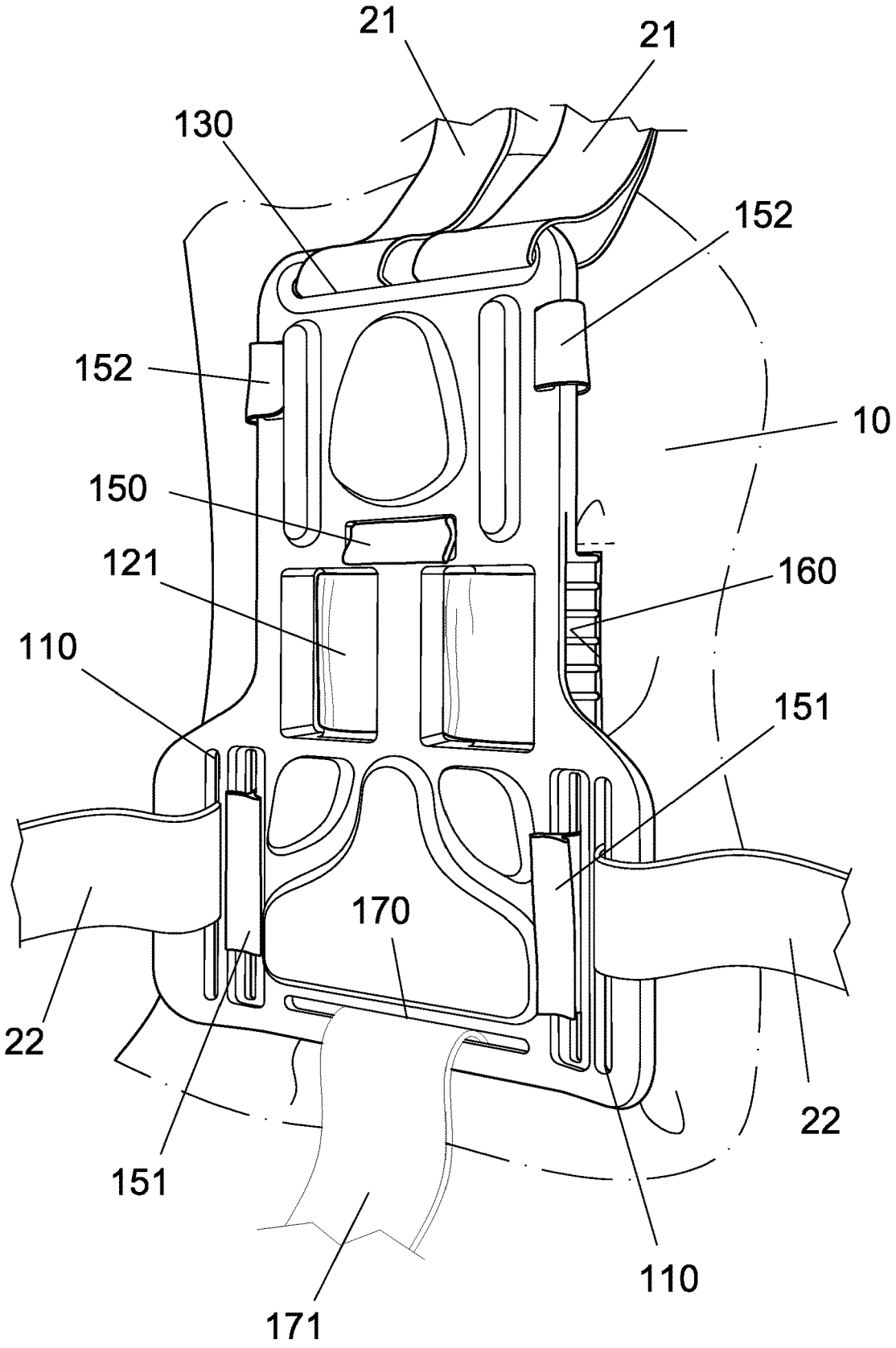
FIG. 3 shows an internal view, relative to the diver's body, of the backrest and the coupling thereof with the BCD.
Figure 4:
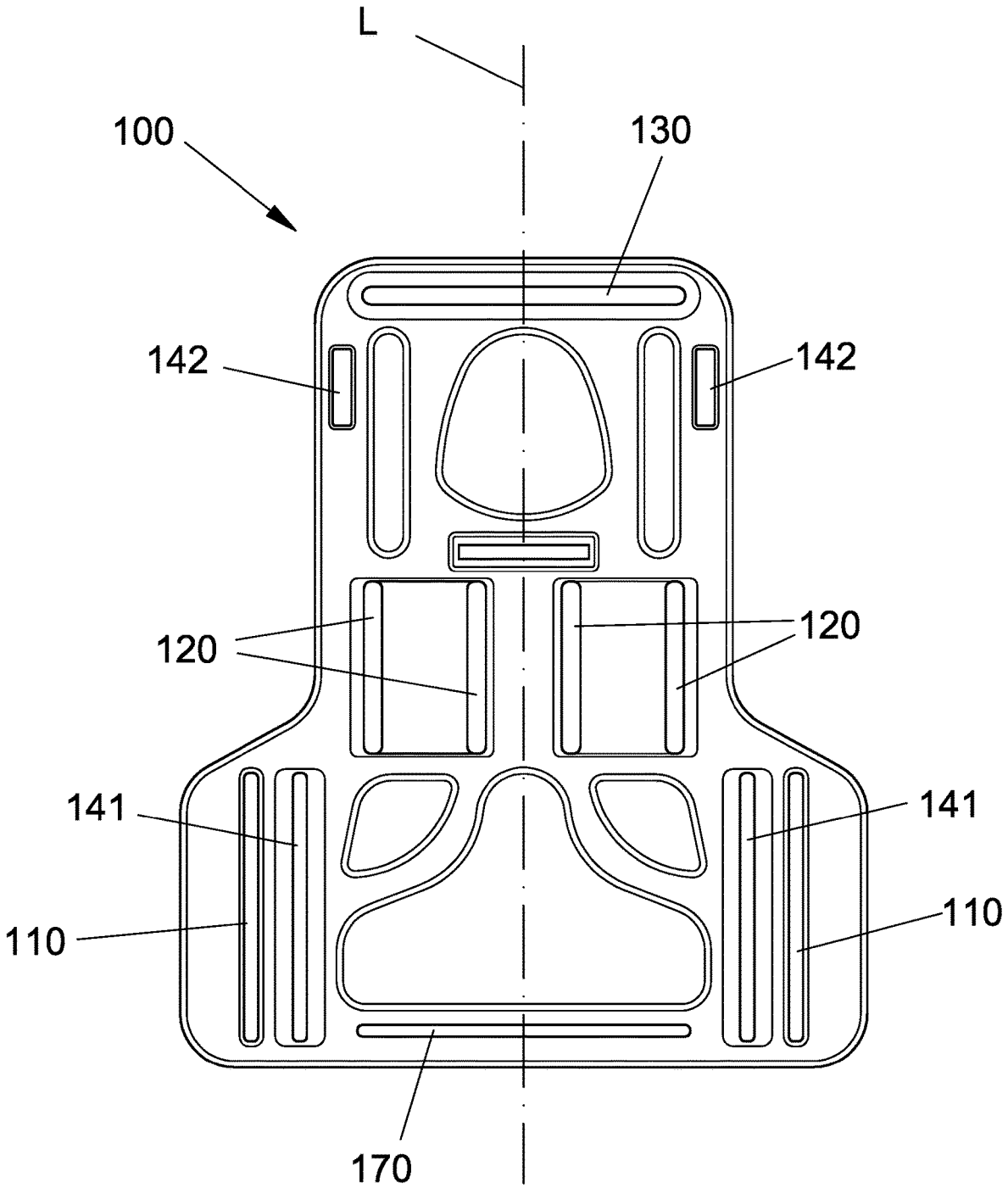
FIG. 4 shows a front view of the backrest.
Figure 4B:
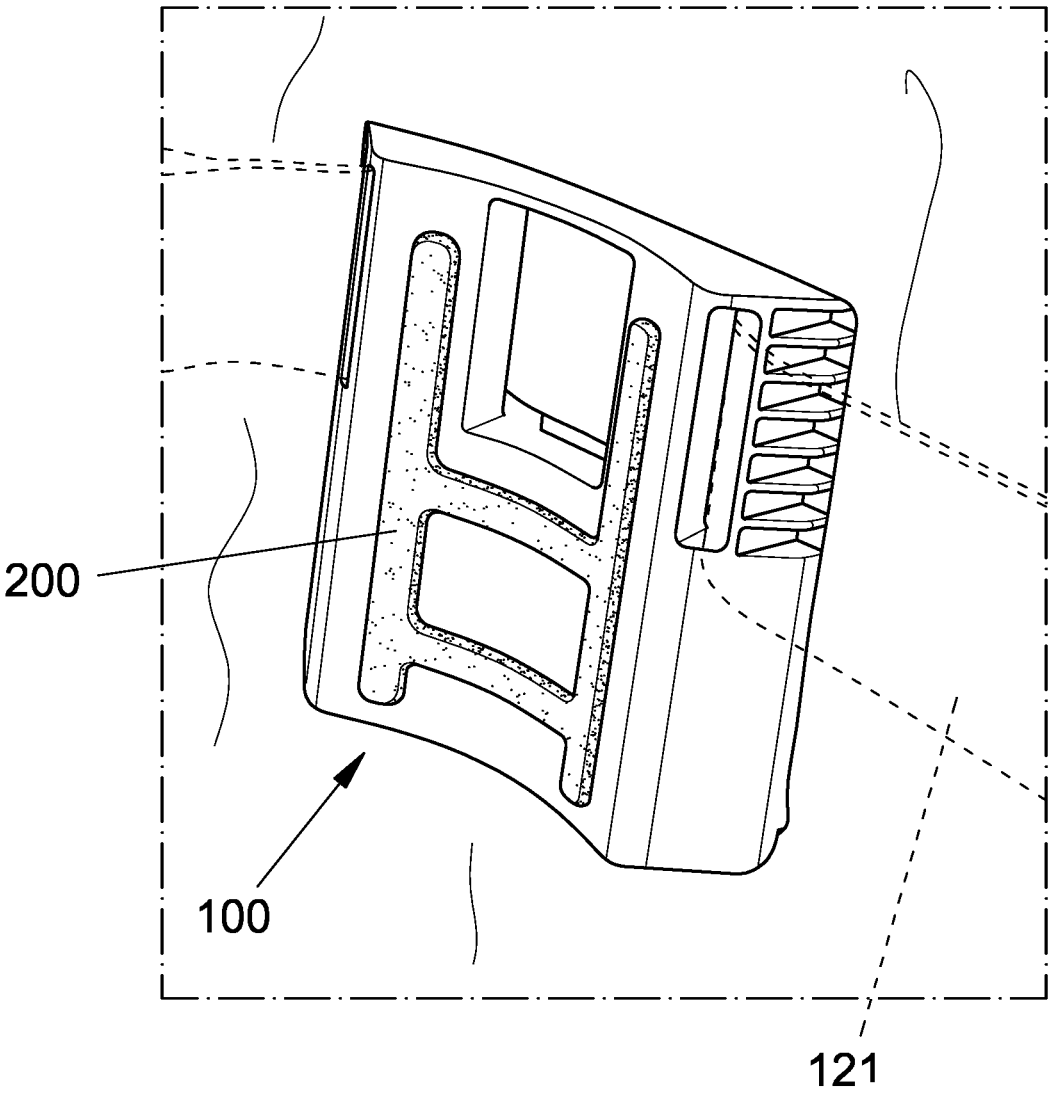
Figure 5:
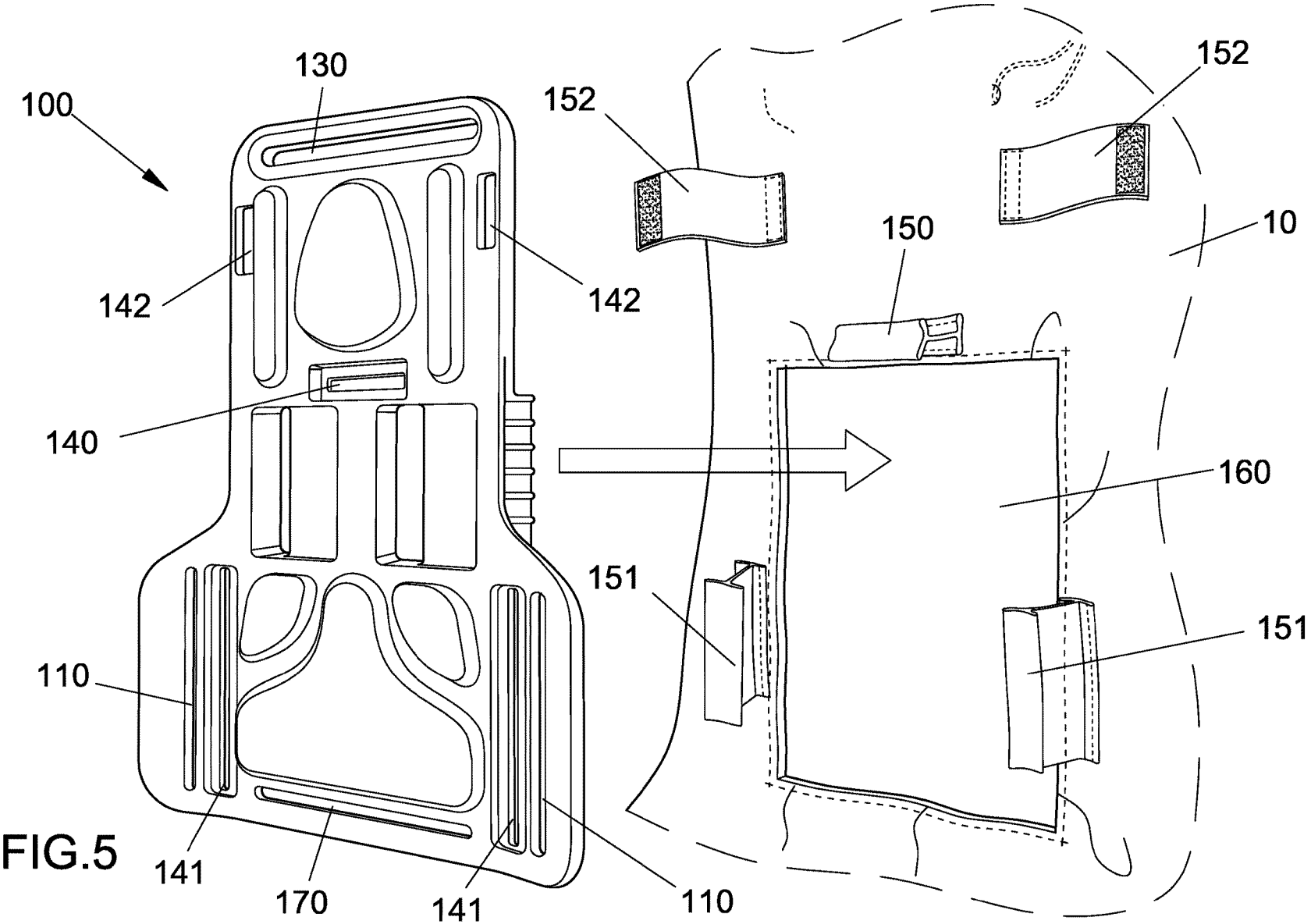

FIG. **4*b*** shows a rear view of the backrest;

FIG. 5 shows the backrest during the step of fixing to the air bladder.

DETAILED DESCRIPTION

With reference to the aforementioned figures, they show a buoyancy control device denoted in its entirety by the reference number 1.

The buoyancy control device 1 substantially comprises a variable volume air chamber or air bladder 10, a harness 20 enabling the BCD to be worn on the diver's body, and a backrest 100 for fixing and supporting at least one air cylinder.

The harness 20 comprises at least two shoulder straps 21 and an abdominal strap made up of two abdominal half-straps 22, as well as, optionally, a crotch strap 171.

The backrest 100 is a mechanical component intended to support the cylinder, or also two cylinders, and secure them to the back of the diver's body and it must thus be particularly robust and offer suitable mechanical characteristics and characteristics of comfort and constraint, consistent with the function to which it is dedicated; it is typically made with a rigid aluminium or technopolymer body.

The backrest 100 extends prevalently along a longitudinal axis L oriented in the direction of the diver's spinal column when the device is worn.

The backrest 100 extends with an upper portion of narrower width and a lower portion with lateral wings.

The backrest 100 is provided with first slots 110 engaged by the abdominal half-straps 22, second slots 120 engaged by at least one retaining strap 121 for retaining at least one air cylinder and one or more third slots 130 engaged by the two shoulder straps 21.

Advantageously, according to the present invention, the backrest 100 comprises one or more fourth slots 140, 141, 142 engaged by corresponding straps 150, 151, 152 for connecting the backrest 100 to the air bladder 10.

Advantageously the connecting straps 150, 151, 152 support the backrest 100 floatingly with respect to the air bladder 10.

The connecting straps 150, 151, 152 are fastened by stitches to the air bladder 10.

The connecting straps 150, 151, 152 are advantageously flexible.

Each connecting strap 150, 151, 152 advantageously removably engages in a fourth corresponding slot 140, 141, 142.

At least one connecting strap 150, 151 has an end with a double lip engaged in a fourth corresponding slot 140, 141.

In particular, the connecting straps 150, 151 have an end with a double lip engaged in the fourth corresponding slot 140, 141 whilst each connecting strap 152 has a hook-and-loop fastening system for connecting to the corresponding fourth slot 142.

In order to connect each connecting strap 150, 151 to the corresponding fourth slot 140, 141, one lip is folded back and in sequence the front lip and then the folded back one are introduced by pressing them through the slot. The advantage, as noted, is that the connection is not permanent, and the connecting strap can be disengaged from and reengaged to the slot when necessary.

The backrest 100 is positioned through a through opening 160 of the air bladder 10.

One or more connecting straps 150, 151 are fixed along the perimeter of the through opening 160.

In particular, the through opening 160 has a quadrangular shape with two connecting straps 151 positioned on two lateral perimeter sides of the through opening 160 and a connecting strap 150 positioned on an upper perimeter side of the through opening 160.

The backrest 100 may also have a fifth slot 170 engaged by a crotch strap 171.

In practical terms, with reference to the longitudinal axis L of the backrest 100, the first slots 110 extend at least prevalently in the direction of the axis L along the lower lateral wings of the backrest 100, the third slot 130 extends transversely to the axis L adjacent to an upper perimeter side of the backrest 100, the fifth slot 170 extends transversely to the axis L adjacent to a lower perimeter side of the backrest 100, the second slots 120 extend at least prevalently in the direction of the axis L in an intermediate position between the third slot 130 and the fifth slot 170, the fourth slot 140 extends transversely to the axis L in a position interposed between the second slots 120 and the third slot 130, the fourth slots 141 extend at least prevalently in the direction of the axis L, in an internal position, each adjacent to a corresponding first slot 110, and the fourth slots 142 extend at least prevalently in the direction of the axis L in a position interposed between the third slot 130 and the fourth slot 140.

As mentioned, said backrest 100 is floating with respect to the air bladder 10, being partially housed inside the through opening 160 on the back of the air bladder 10, thus having a portion of the outer face directly on the outside of the device 1 for supporting and fixing at least one air cylinder.

The operation of the buoyancy control device 1 for scuba diving according to the invention appears clear from what is described and illustrated and, in particular, is substantially the following.

The user/diver positions the first cylinder against the outer portion of the backrest 100 configured to directly support the cylinder and secures it with the retaining strap 121.

He or she proceeds in a similar manner in the event of positioning a second cylinder, independently supported and constrained in a position alongside and parallel to the first cylinder.

The user/diver dons the device 1.

The weight of the cylinder, or cylinders, constrained as described above to the backrest 100 not rigidly connected to the air bladder 1, but rather floatingly fixed by the connecting straps 150, 151, 152, is directly transferred from the backrest 100 to the shoulder straps 21.

The mechanical stresses due to the weight of the cylinder(s) are thus directly transferred to the shoulder straps 21, completely relieving the strain on the air bladder 10, which can thus maintain its structural integrity for a long time.

The user/diver completes the donning of the device 1 with the reciprocal engagement and closure of the two abdominal half-straps 22, and the engagement, adjustment and closure of all the known elements provided on the harness.

Advantageously, the reduced size of the backrest 100, the only rigid element of the entire device 1, which is made with substantially flexible materials, facilitates the folding and packing of the entire device, thus facilitating the transport thereof in situations of travel of the user/diver and/or shipment.

In order to improve the convenience of using the buoyancy control device 1, the backrest can have, on the front and back sides thereof, protuberances 200 made of non-slip material, for example obtained from a rubber material co-moulded with the backrest or applied on the backrest, which on the one hand help to keep the cylinder in position against the backrest, and on the other hand help to maintain the backrest comfortably in position against the diver's back.

It has been ascertained in practice that a buoyancy control device 1 according to the invention is particularly advantageous, since it is robust and resistant, long-lasting, lightweight, comfortable to wear and practical to pack.

A buoyancy control device thus conceived is susceptible of numerous modifications and variants, all falling within the scope of the inventive concept as defined in the claims; furthermore, all of the details are replaceable by technically equivalent elements.

The materials used, as well as the dimensions, may in practice be any whatsoever, according to needs and the state of the art.

What is claimed is:

1. A buoyancy control device for scuba diving comprising:

an air bladder having a through opening, a harness comprising:

at least two shoulder straps, an abdominal strap made up of two abdominal half-straps, and connecting straps independent from the shoulder straps and the abdominal strap, a rigid backrest positioned through said through opening and comprising:

first slots engaged by said abdominal half-straps, second slots engaged by at least one retaining strap retaining at least one air cylinder, one or more third slots engaged by said two shoulder straps, one or more fourth slots engaged by said connecting straps connecting said backrest directly to said air bladder, said one or more fourth slots being slots passing through the thickness of said rigid backrest, and wherein at least one of said connecting straps has a first terminal end with a double lip engaged in the corresponding fourth slot and a second terminal end fixed to the air bladder, said first terminal end facing a front side of the rigid backrest and said second terminal end facing a rear side of said backrest.

2. The buoyancy control device for scuba diving according to claim 1, wherein said connecting straps support said backrest floatingly with respect to said air bladder.

3. The buoyancy control device for scuba diving according to claim 1, wherein said connecting straps are fastened by stitches to said air bladder.

4. The buoyancy control device for scuba diving according to claim 1, wherein said connecting straps are flexible.

5. The buoyancy control device for scuba diving according to claim 1, wherein each connecting strap is removably engaged in a fourth corresponding slot.

6. The buoyancy control device for scuba diving according to claim 1, wherein said one or more connecting straps are fixed along the perimeter of said through opening.

7. The buoyancy control device for scuba diving according to claim 1, wherein said backrest has a fifth slot engaged by a crotch strap.

8. The buoyancy control device for scuba diving according to claim 7, wherein said backrest is formed from a rigid body made of aluminium or technopolymer material.

* * * * *